US010441034B2

(12) United States Patent
Anderson

(10) Patent No.: US 10,441,034 B2
(45) Date of Patent: Oct. 15, 2019

(54) QUICK-RELEASE BUCKLE WITH FIRE STARTER AND METHODS OF USE

(71) Applicant: Casey T. Anderson, St. George, UT (US)

(72) Inventor: Casey T. Anderson, St. George, UT (US)

( * ) Notice: Subject to any disclaimer, the term of this patent is extended or adjusted under 35 U.S.C. 154(b) by 0 days.

(21) Appl. No.: 15/628,443

(22) Filed: Jun. 20, 2017

(65) Prior Publication Data

US 2017/0360159 A1 Dec. 21, 2017

Related U.S. Application Data

(60) Provisional application No. 62/352,335, filed on Jun. 20, 2016.

(51) Int. Cl.

| | |
|---|---|
| ***A44B 11/00*** | (2006.01) |
| ***A44B 11/25*** | (2006.01) |
| ***F23Q 1/06*** | (2006.01) |
| ***A44B 11/26*** | (2006.01) |
| *A44B 99/00* | (2010.01) |

(52) U.S. Cl.

CPC ..... *A44B 11/005* (2013.01); *A44B 11/2592* (2013.01); *A44B 11/266* (2013.01); *F23Q 1/06* (2013.01); *A44B 99/00* (2013.01)

(58) Field of Classification Search

CPC . A44B 11/005; A44B 11/266; A44B 11/2592; A44B 11/2534; A44B 99/00; F23Q 1/06

See application file for complete search history.

(56) References Cited

U.S. PATENT DOCUMENTS

| | | | | |
|---|---|---|---|---|
| 3,589,341 | A * | 6/1971 | Krebs | A01K 27/005 119/865 |
| 3,823,421 | A * | 7/1974 | Collins | A41F 9/002 2/321 |
| 4,100,655 | A * | 7/1978 | Langley | A41F 9/002 2/322 |
| 4,135,267 | A * | 1/1979 | McKinney, Sr. | B25F 1/00 24/163 K |
| 4,384,390 | A * | 5/1983 | Hayakawa | A44B 11/005 224/163 |
| 4,905,878 | A * | 3/1990 | Lovinger | A44B 11/005 224/163 |
| 6,505,385 | B2 * | 1/2003 | Grunberger | A44B 11/2592 24/303 |
| 8,376,199 | B2 * | 2/2013 | Ellis | A45F 5/02 224/163 |
| 2011/0298227 | A1 * | 12/2011 | Fiedler | A45C 13/1069 292/251.5 |
| 2015/0366298 | A1 * | 12/2015 | Blackman | A44B 11/005 431/253 |

* cited by examiner

*Primary Examiner* — Robert Sandy
*Assistant Examiner* — Louis A Mercado
(74) *Attorney, Agent, or Firm* — Gurr Brande & Spendlove, PLLC; Robert A. Gurr

(57) ABSTRACT

A quick-release buckle has a male member and a female member configured to interlock, the female member having a body with a recessed receiving portion and one or more lips overhanging a portion of the recessed receiving portion; the male member having a keyed portion shaped complementary to the recessed receiving portion of the female member; wherein the keyed portion of the male member is receivable within the recessed receiving portion to interlock.

8 Claims, 6 Drawing Sheets

QUICK-RELEASE BUCKLE WITH FIRE STARTER AND METHODS OF USE

CROSS-REFERENCE TO RELATED APPLICATIONS

This application claims the benefit of U.S. Provisional Application Ser. No. 62/352,335, filed on Jun. 20, 2016, which is incorporated herein by reference.

TECHNICAL FIELD

The present disclosure relates to belt buckles. More particularly, the present disclosure is directed to a quick-release buckle with optional fire-starting components and other accessories.

BACKGROUND

Buckles in their many forms have existed in the prior art for years. From standard tongue buckles, to clasps, to side release buckles, and other variants. Due to their typical heavy use, buckles are built to be resilient, yet easy to buckle and unbuckle. One of the most common buckles is the side-release buckle. The male portion of this buckle typically has at least two extensions that are received in a female receiver. To unbuckle it, the user squeezes on the two outer male portions so that they release from a pair of apertures in the female receiver. This buckle works well, but has some drawbacks. One of the biggest problems that remains with the side-release buckle is the tendency of the male portions to become worn out, bent, or broken. The buckle is then rendered useless. Another problem of the side release buckle is the difficulty of users to unbuckle it. For example, the young, the elderly, and those with hand malformations, often struggle to release a side-release buckle. As such, there is a need for a buckle that is not susceptible to wearing out or easily breaking, and that further allows every class of user to use with ease.

Further, there exists a need for a belt buckle that has survival tools built into the buckle, such as fire-starting capabilities, as well as other features, such as can openers. The current disclosure seeks to solve the above described problems, as well as others.

SUMMARY OF EXAMPLE EMBODIMENTS

In one embodiment, a quick-release buckle comprises a female member having a body, the body having a recessed receiving portion and one or more lips overhanging a portion of the recessed receiving portion; a male member having a keyed portion, the keyed portion being shaped complementary to the recessed receiving portion of the female member; wherein the keyed portion of the male member is receivable within the recessed receiving portion.

In one embodiment, a quick-release buckle comprises a female member and a male member configured to interlock, the female member having one or more flint rods coupled thereto and the male member manufactured from a hard metal, such as steel, to act as a striker. It will be appreciated that while the term "flint" is used herein, it typically refers to Ferrocerium. However, other known materials may be used, such as Mischmetal (which contains a lower amount of iron and increased magnesium), or any other firestarter known in the art.

In one embodiment, a quick-release buckle further comprises additional accessories. For example, a can opener, bottle opener, screw driver, or other accessories may be incorporated onto one or more of the male and female members.

DETAILED DESCRIPTION OF EXAMPLE EMBODIMENTS

Figure 1:
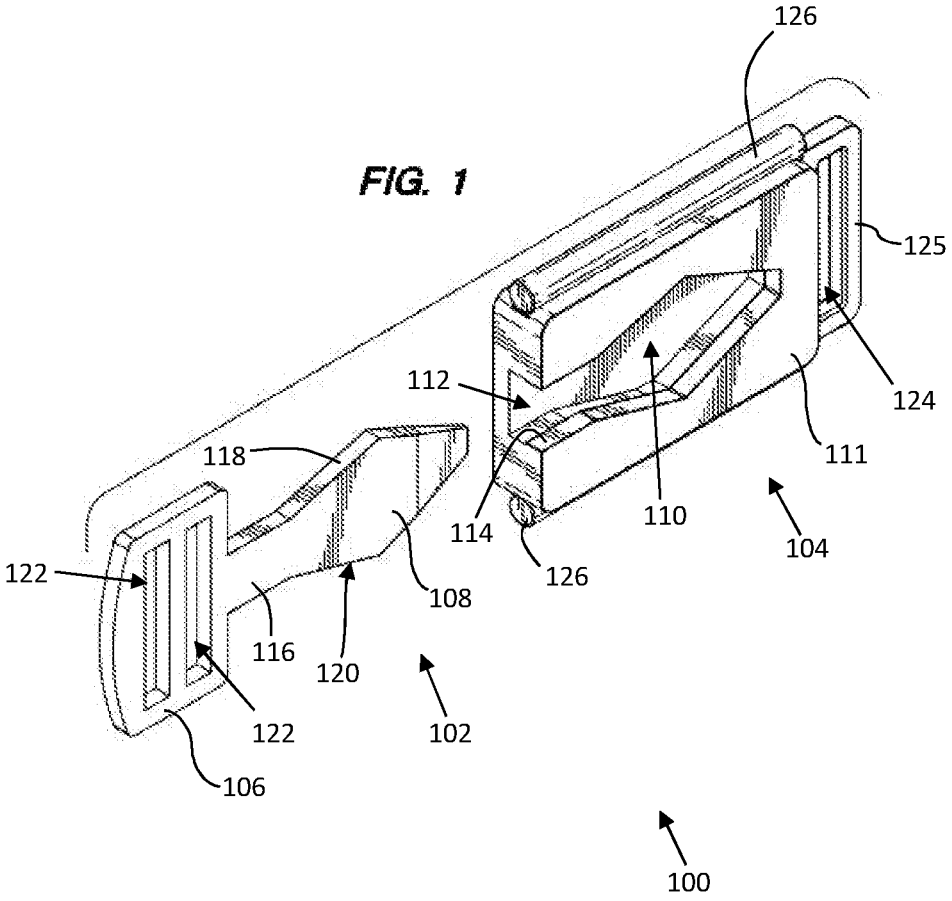
FIG. 1 is a perspective view of a quick-release buckle unbuckled.
Figure 2:
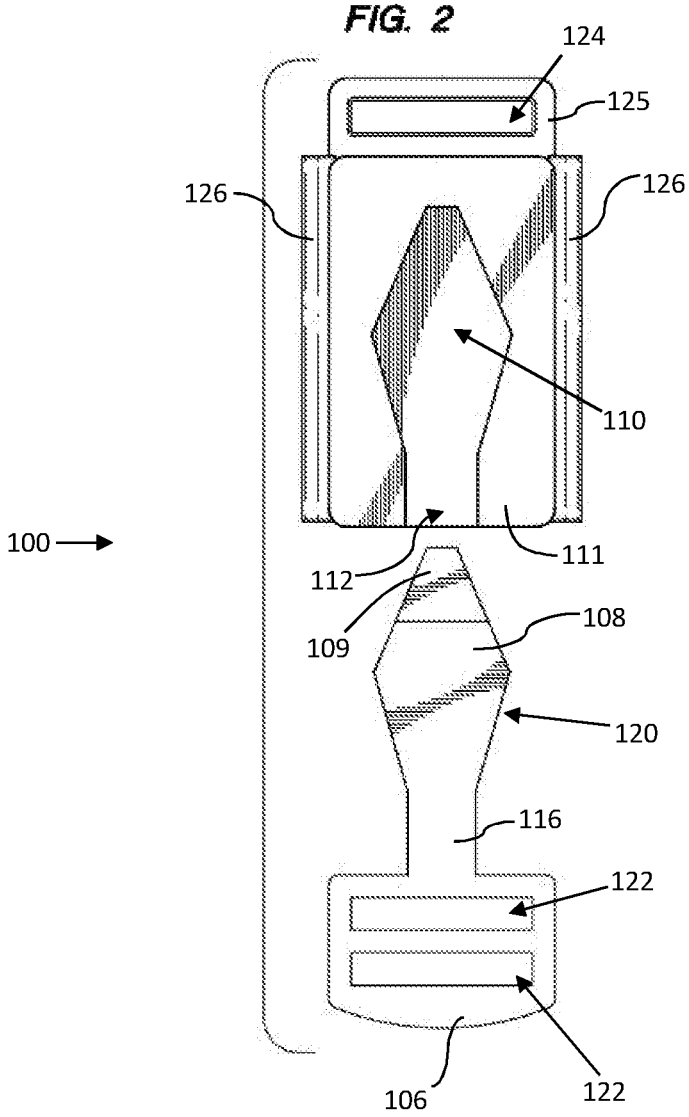
FIG. 2 is a top plan view of a quick-release buckle unbuckled.
Figure 3:
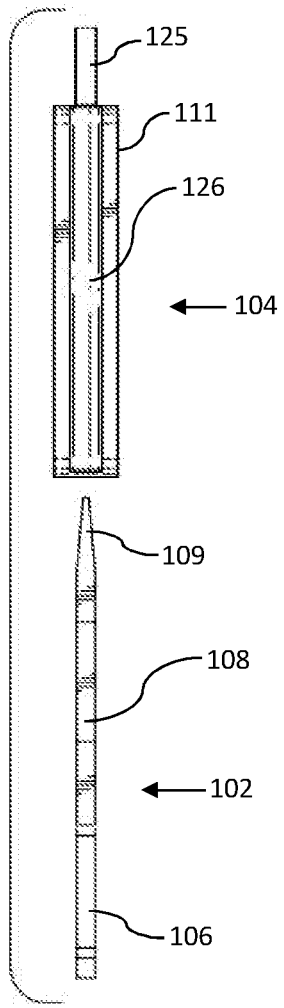
FIG. 3 is a side elevation view of a quick-release buckle unbuckled.
Figure 4:
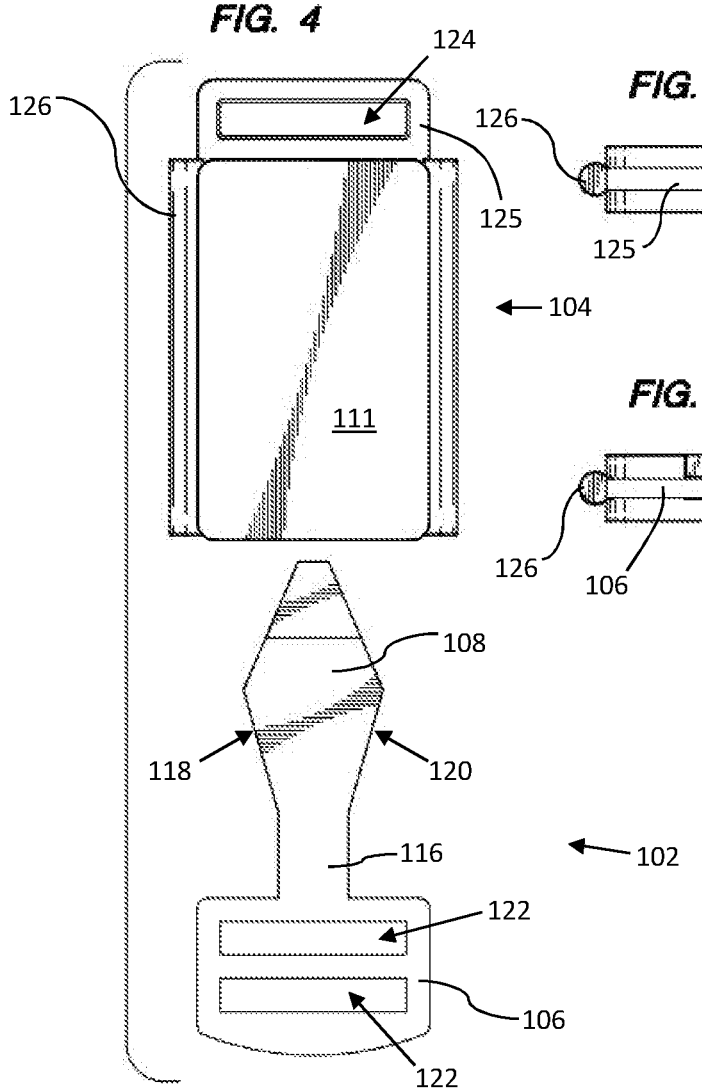
FIG. 4 is a bottom plan view of a quick-release buckle unbuckled.
Figure 5:
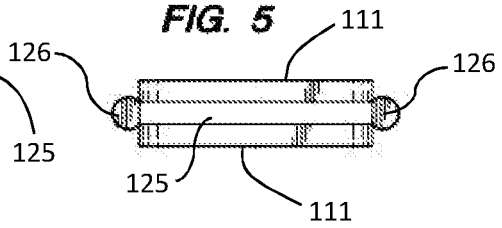
FIG. 5 is a front side elevation view of a quick-release buckle unbuckled.
Figure 6:
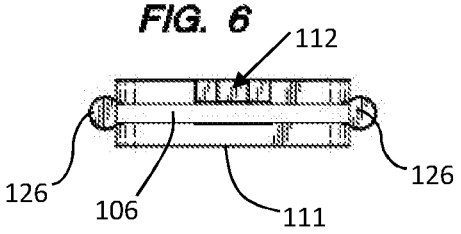
FIG. 6 is a rear side elevation view of a quick-release buckle buckled.
Figure 7:
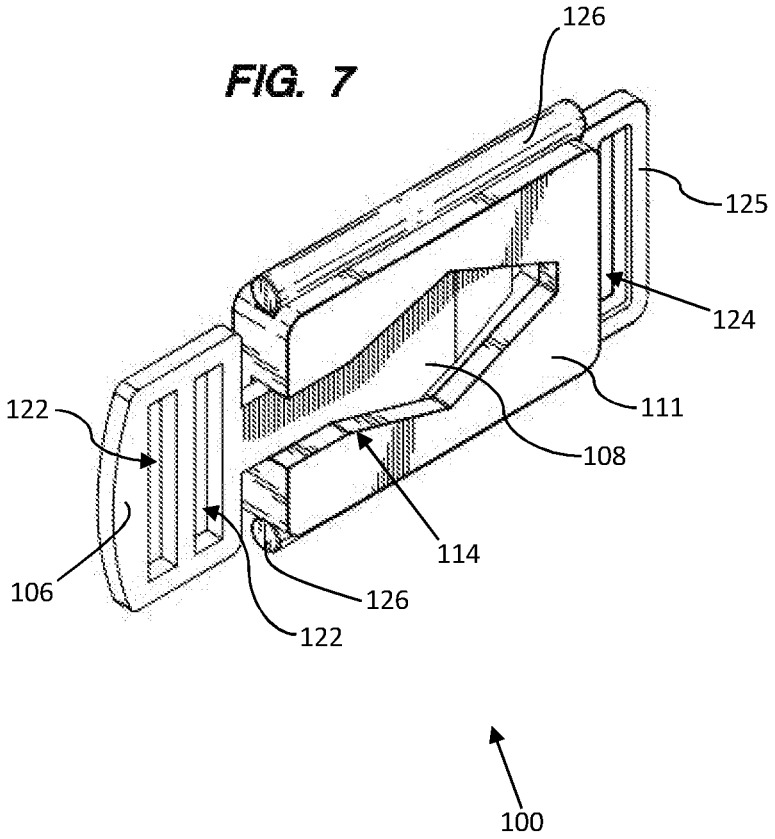
FIG. 7 is a perspective view of a quick-release buckle buckled.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiment," and the like, may indicate that the embodiment(s) so described may include a particular feature, structure, or characteristic, but not every embodiment necessarily includes the particular features, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may. Further, not all drawings may be drawn to scale.

Accordingly, the particular arrangements disclosed are meant to be illustrative only and not limiting as to the scope of the invention. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed process or methods generally may be carried out in various different sequences and arrangements while still falling within the scope of the present invention.

The term "coupled" may mean that two or more elements are in direct physical or electrical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

As previously discussed, there is a need for a buckle that is not susceptible to wearing out or easily breaking, that allows every class of user to use with ease, and that has accessories. The quick-release buckle disclosed herein solve these needs and others.

Figure 8:
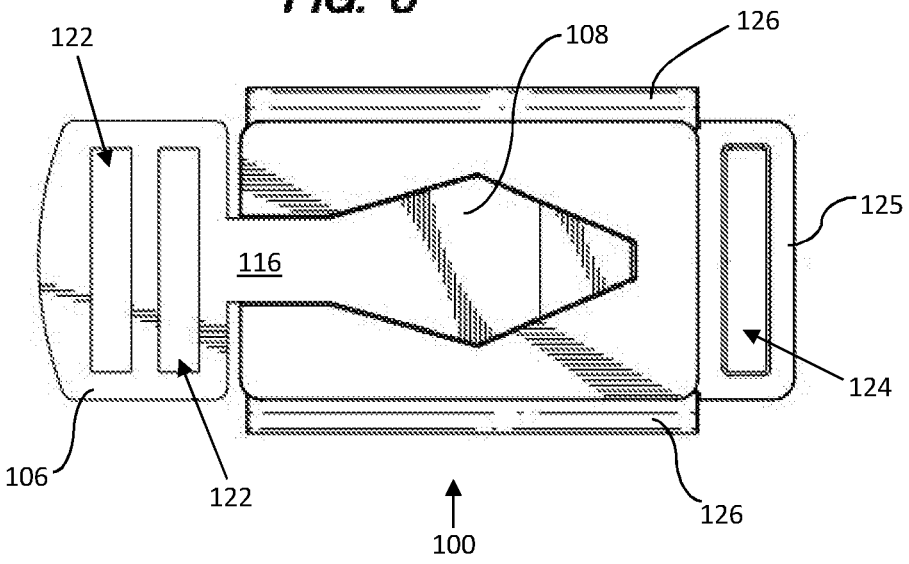
FIG. 8 is a top plan view of a quick-release buckle buckled, but the keyed portion not secured under the lips.
Figure 9:
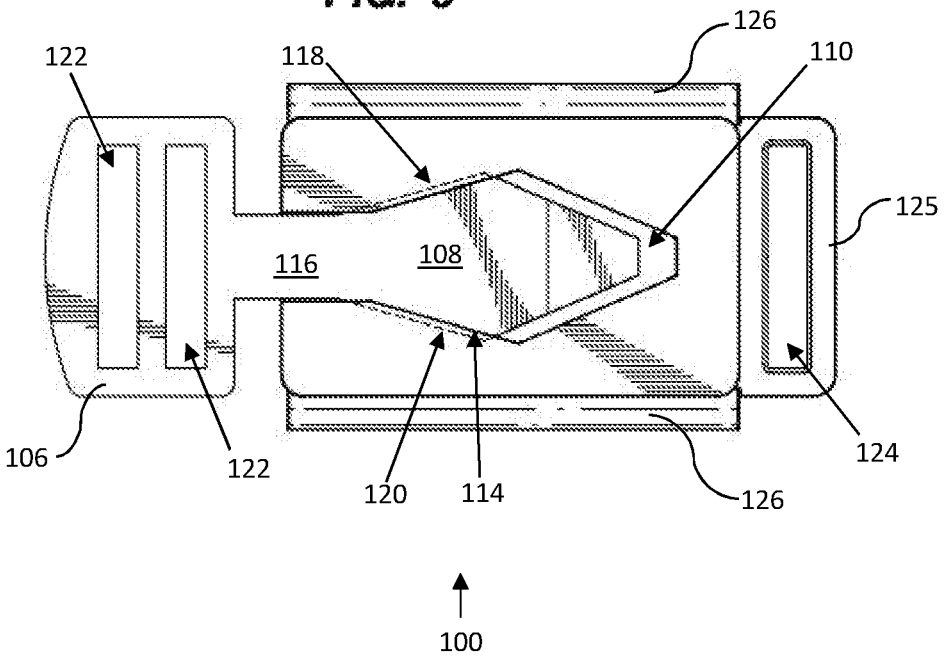
FIG. 9 is a top plan view of a quick-release buckle buckled and the keyed portion secured under the lips.

In one embodiment, as shown in FIGS. 1-9, a quick-release buckle 100 comprises a male member 102 and a female member 104 configured to interlock. For example, male member 102 has a base 106 for receiving straps and a keyed portion 108 for coupling to the female member 104. It will be understood that the keyed portion 108 may be in any number of sizes and configurations. As non-limiting examples, the keyed portion 108 may be rounded, square, triangle, letters, numbers, or simply random shapes and sizes. It will be understood that "keyed" simply means that the keyed portion 108 is sized and configured so as to be received within a complementary sized and shaped recessed receiving portion 110 of the body 111 of the female member 104. Keyed portion 108 is wider in size than neck portion 116. This prohibits the withdrawal of the keyed portion 108 through the opening 112 (i.e., the keyed portion will not slide out of opening 112). In order to be removed, keyed portion 108 must be lifted out of receiving portion 110. Further, opening 112 may have overhanging edges, protrusions, or lips 114 that prohibit the lifting and withdrawal of the keyed portion 108 when fully-seated in receiving portion 110. Fully-seated means that the neck 116 is seated within opening 112, and is extended longitudinally (the keyed portion 108 sliding toward the opening 112) until one or more sides 118, 120 of the keyed portion 108 abut the inner walls of opening 112. In such a position, and as best seen in FIG. 9, the lips 114 overlap the keyed portion 108 (or overlap at least one or more sides 118, 120), prohibiting withdrawal of the male member 102 from the female member 104 using outward force. In order to release the male member 102 from the female member 104, the base member 106 is pushed toward the female member 104, which causes the lips 114 to not overlap the keyed portion 108 (as shown in FIG. 8), allowing the keyed portion 108 to be extracted from the receiving portion 110. As such, it is readily apparent that the receiving portion 110 is slightly longer and wider in size than the keyed portion 108, with the neck 116 being sufficiently long such that when the base 106 abuts the female member 104, the keyed portion 108 is freely removeable (i.e., not underneath lips 114), as shown in FIG. 8.

In an example of use as a belt buckle, a user would insert the keyed portion 108 of the male member 102 into the receiving portion 110 of the female member 104. The tension of the belt pulls on the base 106 of the male member 102, causing the neck 116 to be pulled and extend longitudinally from the opening 112. This, in turn, causes the keyed portion 108 to slide underneath the lips 114 such that the keyed portion 108 cannot fall out of the receiving portion 110 of the female member 104. When a user desires to unbuckle the quick-release buckle assembly 100, the user relieves the tension on the belt, which allows the user to push the base 106 of the male member 102 toward the female member 104, thereby freeing (i.e., dislodging) the keyed portion 108 from under the lips 114, allowing the keyed portion 108 to thereby be removed from the receiving portion 110. The belt or straps may be inserted through one or more male strap apertures 122 in base 106 and female strap apertures 124 in loop 125.

The body 111 of female member 104 may be formed from a solid piece of metal, with the recessed receiving portion 110 being milled out. As such, the male member 102 seats within the milled-out, recessed receiving portion 110 of the female member 104. It will be appreciated that while milling is given as an example, other methods may be used to create the recessed receiving portion 110, such as having it forged, cast, die cast, molded, stamped, stacked, etc. The male member 102 is typically held underneath the lips 114 using tension, but it will be appreciated that when the buckle is used in a vertical or semi-vertical position, such as on a backpack buckle, gravity alone will position the male member 102 under the lips 114 such that tension is not required. In other embodiments, one or more magnets may be used as either, or both of, a guiding mechanism into the receiving portion 110 or to aid in keeping the male member 102 and the female member 104 coupled together without needing tension or gravity. The magnets may be embedded in the members 102, 104 or may be coupled thereto so as to not interfere with the coupling mechanism (i.e., the male member 102 inserting into the female member 104).

The benefits of the quick-release buckle 100 are numerous. For example, the male member 102 may be easily inserted into the female member 104 such that any class of person may operate it, both to buckle and unbuckle. Further, because the buckle 100 does not rely on moving parts or other pieces susceptible to failure, the buckle 100 significantly outlasts other buckles in the industry. It will also be appreciated that the quick-release buckle 100 described herein may be used in any number of places that buckles are typically used, such as on belts, straps for backpacks, rifle slings, etc.

Explained another way, the female keyed receiving portion 110 comprises an interlocking recess (e.g., opening) 112 such that the keyed portion 108 of the male member 102 interlocks with, and is secured by, the opposing protrusions (e.g., lips) 114 of the female member 104. The protrusions may simply be lips of the upper surface, the interlocking recess 112 being milled out (or its equivalent), or any other method of configuring an edge to overlap the keyed portion 108 when fully-seated. Again, the male keyed portion 108 may be in any number of sizes and configurations. As non-limiting examples, the keyed portion 108 may be rounded, square, triangle, letters, numbers, or simply random shapes and sizes. It will be understood that "keyed" simply means that the male portion is sized and configured so as to be received within a complementary sized and shaped receiving portion in a female member, and that the configuration prevents the male member 102 from exiting longitudinally from the female member 104 (i.e., exiting through opening 112).

In one embodiment, the quick-release buckle 100 further comprises one or more flint rods 126 coupled thereto, the male member 102 being manufactured from a hard metal, such as steel, to act as a striker. For example, a user would withdraw the male member 102 from female member 104, whereupon the user could strike the male member 102 (e.g., keyed portion 108) against a flint rod 126 so as to create a spark and start a fire, as is well known in the industry of fire starting. The flint rods 126 may be coupled to the female member 104 in a variety of ways. As non-limiting examples, the flint rods 126 may be glued to the female member, may be threaded to the female member (e.g., one end of the flint rod may be threaded so as to be received by a threaded receiver in the female member; see FIGS. 10A & 10B as an example), or otherwise coupled thereto. Also, it will be appreciated that while flint rods 126 are used as an example herein, other fire-starting materials may be used, such as ferro rods, magnesium rods, or any other known alternative. For example, the male member 102 may be used as both a scraper/shaver for magnesium rod(s), after which it may also be used to strike against another rod or surface to create a spark and ignite the magnesium. In one embodiment, the female member 104 may have a magnesium rod on a first side and a flint rod on a second side. It will be appreciated that any number of combinations may be used. The tip 109 of the keyed portion 108 may be shaped (e.g., tapered) so as to be a flat-head screwdriver or blade.

In one embodiment, a quick-release buckle assembly may comprise various components for assembly by a user. The buckle assembly comprising a male member and a female assembly. The female assembly comprises a base plate, a middle plate, and a top plate. Each plate having apertures for receiving a coupling means, such as screws, bolts, rivets, or some equivalent. In some embodiments, soldering, gluing, or other methods of adhering one plate to another may be used. The middle plate and top plate comprising a receiving cutout. The top plate having one or more lips or protrusions so at to prevent the male member from being withdrawn when interlocked. It will be noted that while only the female member is discussed as being an assembly of multiple plates, it will be appreciated that the male portion may also be similarly constructed, such that it is designed for assembly by a user. In such an instance, a user may additionally couple one or more desired accessories to the male or female portion during assembly. In other words, an accessory plate may be inserted within the outer plates during assembly.

Figure 10A:
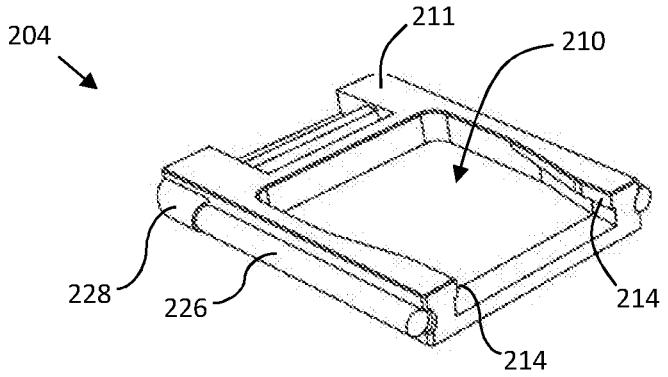
FIG. 10A is a perspective view of a female member of a quick-release buckle.
Figure 10B:
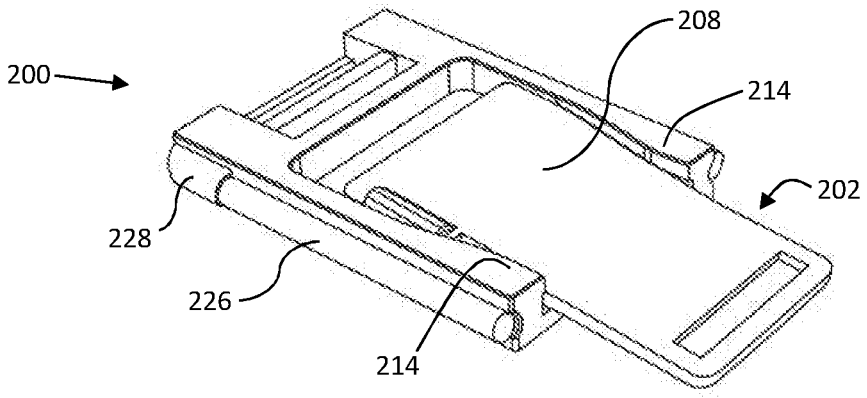
FIG. 10B is a perspective view of a quick-release buckle buckled.
Figure 10C:
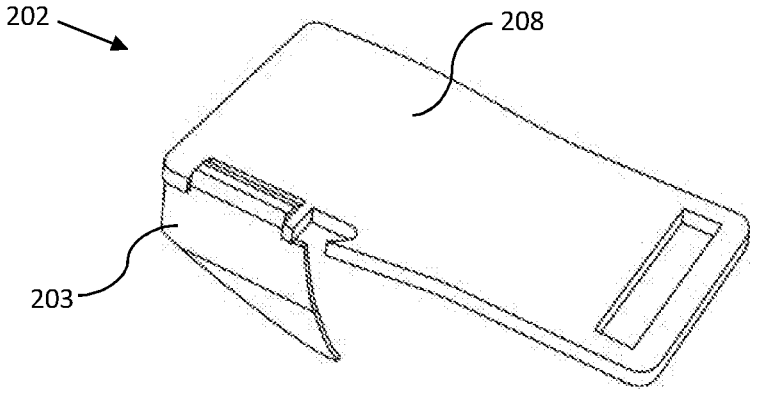
FIG. 10C is a perspective view of a male member with a can opener blade of a quick-release buckle.

In one embodiment, as shown in FIGS. 10A-10C, a quick-release buckle 200 comprises a male member 202 having a can opener blade 203, and a female member 204. As shown, the can opener blade 203 is foldable, such that it remains secured between the male member 202 and female member 204 when not being used. In other words, can opener blade 203 may be foldable, hinged, spring-hinged, etc. When not in use, a user would fold the can-opener blade 203 (or otherwise allow the can-opener blade 203 to spring back) underneath the male member 202, where it will not interfere with the male member 202 interlocking with the female member 204. In other words, with can opener blade 203 beneath the male member 202, the keyed portion 208 is inserted into the complementary shaped receiving opening 210. The user then pulls the male member 202 and female member 204 away from each other, causing the male member 202 to slide underneath edges 214, thereby keeping the male member 202 and the female member 204 interlocked. When male member 202 and female member 204 are coupled (interlocked), the can-opener blade 203 is secured due to being interposed between the male member 202 and the female member 204. To release, the male member 202 and the female member 204 are pushed towards one another, causing the keyed portion 208 to slide out from the edges 214, allowing the keyed portion 208 to be removed from the female member. While a can opener is used as an example, other accessories may also be used, such as a bottle opener, screw driver, or other accessories. Further, as shown in FIGS. 10A-10C, the flint rods 226 may be coupled to the body 211 using a rod coupler 228. The rod coupler 228 may be threaded or simply a shaft for receiving an end of a flint rod 226.

Lastly, it will be appreciated that while the male members and female members disclosed throughout herein are ideally made of metal, they may also be made from sturdy plastics, carbon fibers, steel, aluminum, titanium, or any other material that is sufficiently rigid and able to function as a buckle. The quick-release buckle disclosed herein need not have fire-starting components. If fire-starting components are desired to be used when plastics or other non-sparking materials are used for the male portion, the male portion could be manufactured to have an edge (or some other portion) made from metal that may be used as the striker/scraper for use with the rods. Further, the male member and female member/assembly may be manufactured in a variety of ways, such as being milled, stamped, forged, die cast, molded, heat pressed, welded, soldered, etc.

It is appreciated from the foregoing that the quick-release buckle described herein solves the need for a buckle that is not susceptible to wearing out or easily breaking, that allows every class of user to use with ease, and that has accessories.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A quick-release buckle, comprising:

a female member having a cuboidal body, the cuboidal body having a recessed receiving portion on a top side of the cuboidal body, the recessed receiving portion comprising a neck receiving portion on the top side of the cuboidal body and an opening on a rear side of the cuboidal body, the cuboidal body having one or more edges overhanging at least a portion of the recessed receiving portion;

a male member having a keyed portion, a neck, and a base with one or more strap apertures, the keyed portion being shaped complementary to the recessed receiving portion of the female member and the neck receivable within the neck receiving portion of the female member;

wherein the keyed portion and the neck of the male member are simultaneously receivable within the recessed receiving portion and the keyed portion is slidable at least partially beneath the edges overhanging the recessed receiving portion of the female member, the neck extending out of the opening on the rear side of the cuboidal body of the female member.

2. The quick-release buckle of claim 1, wherein the female member further comprises at least one flint rod.

3. The quick-release buckle of claim 1, wherein the male member further comprises a tip configured as a flat-head screwdriver.

4. The quick-release buckle of claim 1, wherein the male member further comprises a can opener blade.

5. The quick-release buckle of claim 4, wherein the can opener is foldable so as to be interposed between the male member and the female member when the male member is inserted into the recessed receiving portion of the female member.

6. A quick-release buckle, comprising:

a female member comprising a body, the body having a recessed receiving portion on a top side of the body, the recessed receiving portion comprising a neck receiving portion on the top side of the body and an opening on a rear side of the body, the female member further comprising at least one flint rod;

a male member having a keyed portion, the keyed portion being shaped complementary to the recessed receiving portion of the female member and a neck;

wherein the keyed portion and the neck of the male member is receivable within the recessed receiving portion and the neck receiving portion of the female member, respectively.

7. A quick-release buckle, comprising:

a female member comprising a body, the body having a recessed receiving portion on a top side of the body, the recessed receiving portion comprising a neck receiving portion on the top side of the body and an opening on a rear side of the body;

a male member having a keyed portion, the keyed portion being shaped complementary to the recessed receiving portion of the female member and a neck, the male member comprising a tip configured as a flat-head screwdriver;

wherein the keyed portion and neck of the male member is receivable within the recessed receiving portion and the neck receiving portion of the female member, respectively.

8. A quick-release buckle, comprising:

a female member comprising a body, the body having a recessed receiving portion on a top side of the body, the recessed receiving portion comprising a neck receiving portion on the top side of the body and an opening on a rear side of the body;

a male member having a keyed portion, the keyed portion being shaped complementary to the recessed receiving portion of the female member and a neck, the male member further comprising a can opener blade;

wherein the keyed portion and neck of the male member is receivable within the recessed receiving portion and the neck receiving portion of the female member, respectively; and wherein the can opener blade is foldable so as to be interposed between the male member and the female member when the male member is inserted into the female member.

* * * * *